US005931409A

United States Patent [19]

Nulle et al.

[11] Patent Number: 5,931,409

[45] Date of Patent: Aug. 3, 1999

[54] DISPOSABLE PRESSWOOD REEL AND FLANGES THEREFOR

[75] Inventors: Henner H. Nulle, Canton, Ohio; Dale R. Hart, Nesbit, Miss.

[73] Assignee: Inca Presswood-Pallets. Ltd., Dover, Ohio

[21] Appl. No.: 08/908,107

[22] Filed: Aug. 11, 1997

[51] Int. Cl.[6] ..... B65H 75/18

[52] U.S. Cl. ..... 242/605; 242/608.2; 242/608.8; 242/610.4

[58] Field of Search ..... 242/605, 608.2, 242/608.8, 610.4, 610, 613.5, 614, 118.61

[56] References Cited

U.S. PATENT DOCUMENTS

| | | | |
|---|---|---|---|
| 391,456 | 10/1888 | Cross | 242/118.61 |
| 602,241 | 4/1898 | Pendleton | 242/118.61 |
| 602,260 | 4/1898 | Klots | 242/118.61 |
| 1,462,192 | 7/1923 | Clinton | 242/608.8 |
| 2,753,622 | 7/1956 | Bieber et al. | 242/608.8 |
| 3,289,965 | 12/1966 | Cuva | 242/608.8 |
| 3,508,719 | 4/1970 | Browning | 242/605 |
| 3,970,267 | 7/1976 | Sheetz | 242/605 |
| 4,052,020 | 10/1977 | Knox | 242/608.8 |
| 4,747,563 | 5/1988 | Sasaki et al. | 242/605 |
| 4,880,180 | 11/1989 | Adair | 242/608.8 |
| 5,400,567 | 3/1995 | Lindstrand | 53/399 |
| 5,417,384 | 5/1995 | Lindstrand | 242/557 |
| 5,556,055 | 9/1996 | Lindstrand | 242/608.2 |

FOREIGN PATENT DOCUMENTS

WO 95/26313 10/1995 WIPO .

*Primary Examiner*—John M. Jillions
*Attorney, Agent, or Firm*—Sand & Sebolt

[57] ABSTRACT

A disposable presswood reel has a cylindrical sleeve and two circular end flanges which attach to opposite ends of the sleeve. Each flange includes a pair of spaced parallel outwardly extending annular ribs which form a retaining groove therebetween. The retaining groove is tapered and has a bottom width slightly less than a wall thickness of the sleeve. The ends of the sleeve are inserted within the retaining groove to frictionally secure the flanges to the ends of the sleeve by a forced wedge fit. An adhesive channel is formed in an inner surface of one of the ribs for receiving an adhesive. The adhesive in the channel forms a solid locking ring between the flanges and the sleeve for securing the flanges to the sleeve. One of the pair of flange ribs is slightly taller than the other rib. An annular nesting groove is formed in an outer surface of each flange and receives the taller rib of an adjacent flange for vertically nesting and stacking the flanges on one another during shipping and storage.

17 Claims, 2 Drawing Sheets

DISPOSABLE PRESSWOOD REEL AND FLANGES THEREFOR

BACKGROUND OF THE INVENTION

1. Technical Field

Generally, the invention relates to disposable reels. Particularly, the invention relates to a disposable presswood reel having a tubular sleeve and flanges which attach to each end of the sleeve. More particularly, the invention relates to a disposable reel having one-piece molded spool flanges formed with an integral retaining groove which receives the ends of the sleeve and in which the flanges are nestable within each other to facilitate uniform stacking of the flanges during shipping and storage.

2. Background Information

Using spool reels or drums to carry coils of continuous flexible objects such as cable, line, wire cable, rope, ribbon, housing, chain or the like, is well known in the reel art. Conventional reels were formed of a wooden cylindrical sleeve having a pair of circular flanges attached to each end thereof to retain the coil in a wrapped configuration on the sleeve. These wooden reels are expensive, thus requiring that the reels be reused several times in order to make the use of these reels economically efficient. However, reusing these reels is difficult because the large and bulky size of the reels causes the reels to occupy a great deal of space during transportation of the reel from the work site where the reel is emptied to the coil manufacturer which rewinds the reel with additional coil.

Further, these prior art reels are constructed of wood or plywood which require metal hardware such as brackets, long bolts and nuts to hold each flange against the sleeve. The wood material is capable of being recycled but requires the nuts and bolts to be removed from the reel and separated from the wood product before the wood can be recycled. The metal hardware increases the cost of the wooden reels and increases the time required to assemble the nuts and bolts to the flanges and sleeve. Also, because the sleeve is made of paper and secured to the wood flanges by the metal tie rods, the sleeve will absorb moisture and loose compressive strength whereby the tie rod force will collapse to a slight degree the paper sleeve which will loosen the entire reel.

Many disposable reels or drums have been developed which address the problem of transporting the heavy and bulky reels from the work site to the manufacturer for reuse and which are free of metal hardware which must be removed from the reel before the wooden or paper materials can be recycled and which reduces the cost of manufacture and assembly of the reels.

For example, WO 95/26313 discloses a disposable drum having a pair of circular end flanges connected to a center sleeve by a pair of plugs. The end flanges slide over the cylindrical sleeve and the plugs frictionally fit within the opening formed in each end of the sleeve. Each plug has an outer annular flange having a diameter greater than the diameter of the openings of each end flange causing the plug to abut and retain the end flanges on the sleeve. In an alternative embodiment, each end flange has an inwardly extending plug which frictionally engages the opening of the sleeve to frictionally retain each end flange to one end of the sleeve.

U.S. Pat. No. 5,400,567 discloses a method of manufacturing a coil of a continuous flexible object and enveloping the coil to form a parcel. The object is coiled onto an axially open, cylindrical sleeve having two circular annular flat protective disks lockably joined to the sleeve. A plurality of bands are threaded through the sleeve and apertures formed in the protective disks, whereafter the bands are stretched taut and their ends joined to a permanent joint. Each band thus extends axially with the sleeve and transversely over the turns of the cable or line in an endless loop.

U.S. Pat. No. 5,556,055 discloses a disposable drum with friction-fit components. The disposable drum includes a cylindrical sleeve and two circular flat end pieces which are firmly secured to opposite ends of the sleeve. Each end piece has an inwardly extending annular flange formed with peripheral protrusions located on the outside of the flange. The protrusions form sharp edges which engage the inner surface of the sleeve to retain the end pieces thereto. In a second embodiment, a groove is formed in the end pieces outside of and adjacent to the flange. The groove receives the end of the sleeve with glue, nails or screws joining the end pieces to the sleeve.

Although these drums are adequate for the purpose for which they are intended, these drums require additional parts such as a band wrapped around the protective rings, plugs which engage the reel or sleeve to hold the flanges thereto or an inner flange having a complicated molding or manufacturing process necessary to form the protruding edges thereon. Additionally, the second embodiment of U.S. Pat. No. 5,556,055 does not disclose sufficient space to hold the glue or adhesive and does not allow the glue or adhesive to sufficiently grip or adhere to the parts being held together thereby. When the sleeve of the '055 patent is inserted within the groove of the end pieces, the tight friction fit therebetween forces or squeezes a majority of the adhesive out of the groove leaving little adhesive left to form the bond. This small amount of adhesive creates a poor bond between the sleeve and the end pieces and creates an unstable reel or drum.

Therefore, the need exists for an improved disposable presswood reel and flanges therefor in which the flanges are a one-piece molded member which is attachable to the reel with an adhesive bond free of any hardware, in which the flanges are nestable allowing the flanges to be stacked on one another for easy shipping and storage, and which are lightweight and disposable allowing the drums to be recycled or otherwise disposed of.

SUMMARY OF THE INVENTION

Objectives of the invention include providing an improved disposable presswood reel and flanges therefor in which the flanges frictionally engage a tubular sleeve of the reel.

Another objective is to provide a disposable reel in which the flanges are formed with a retaining groove which receives an end of the sleeve.

A further objective is to provide a reel which is free of hardware such as nuts, bolts and brackets.

A still further objective is to provide a reel in which the flanges are nestable with one another allowing the flanges to be stacked vertically for easy shipping and storage.

Another objective is to provide a reel which is lightweight and inexpensive to manufacture; and which may be recycled or otherwise discarded after use.

A further objective is to provide a reel which may receive a small amount of adhesive to retain the reel to the flanges.

A still further objective is to provide a reel which is of simple construction, which achieves the stated objectives in a simple, effective and inexpensive manner, which solves problems and satisfies need existing in the art.

These objectives and advantages may be obtained by the disposable presswood reel of the present invention, the general nature of which may be stated as including a cylindrical sleeve formed with a central opening and having inner and outer surfaces and first and second end surfaces; first and second end flanges, each end flange having inner and outer surfaces; an annular groove formed in the inner surface of each end flange for receiving one of the first and second end surfaces of the sleeve, said groove having inner and outer edges; and a channel formed in one of the edges of the groove and communicating with said groove for receiving an adhesive for securing the sleeve to the end flanges.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
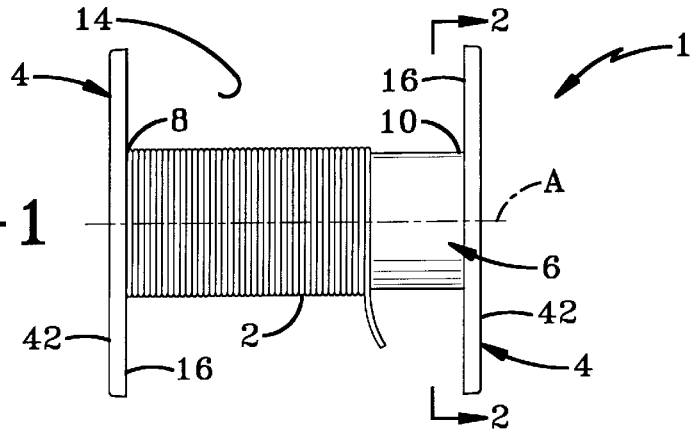
FIG. 1 is a side elevational view of the disposable presswood reel and flanges therefor of the present invention shown with a cable coiled around the sleeve of the reel.
Figure 2:
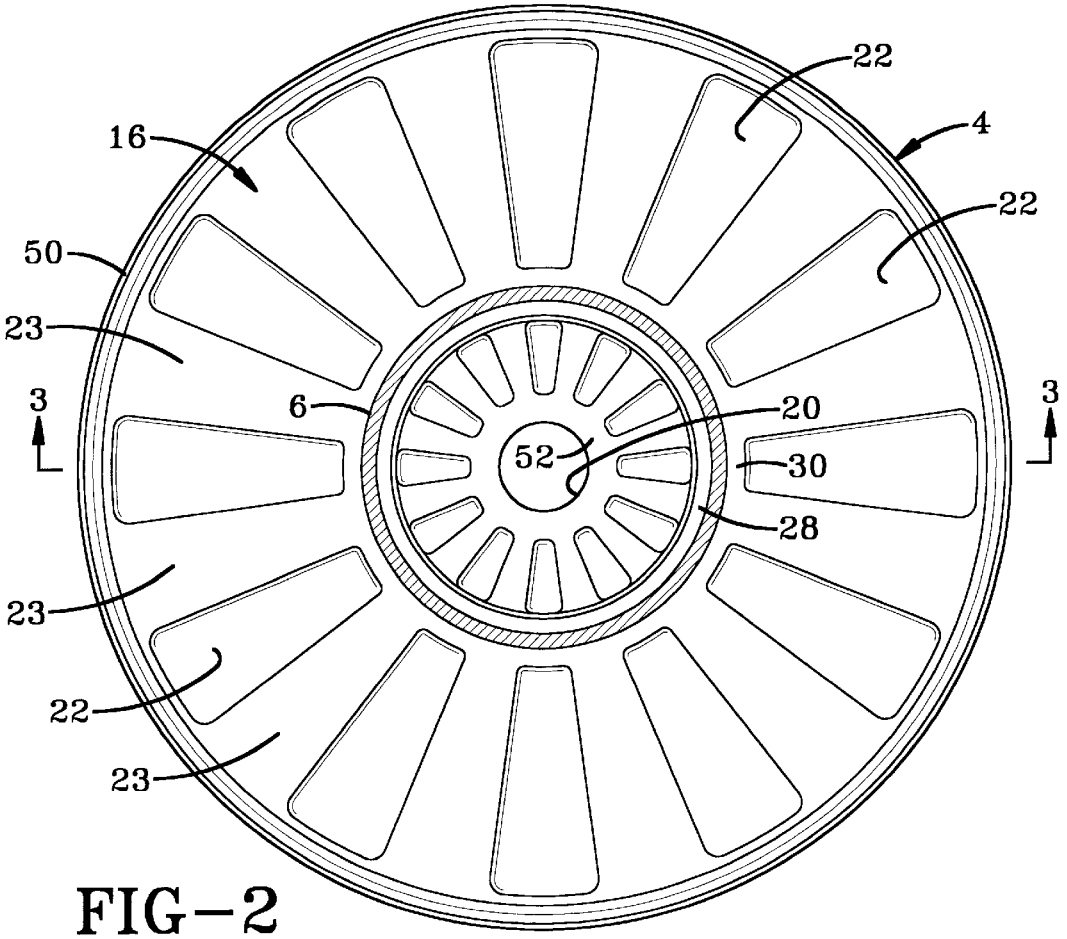
FIG. 2 is an enlarged sectional view taken along line 2—2, FIG. 1.
Figure 4:
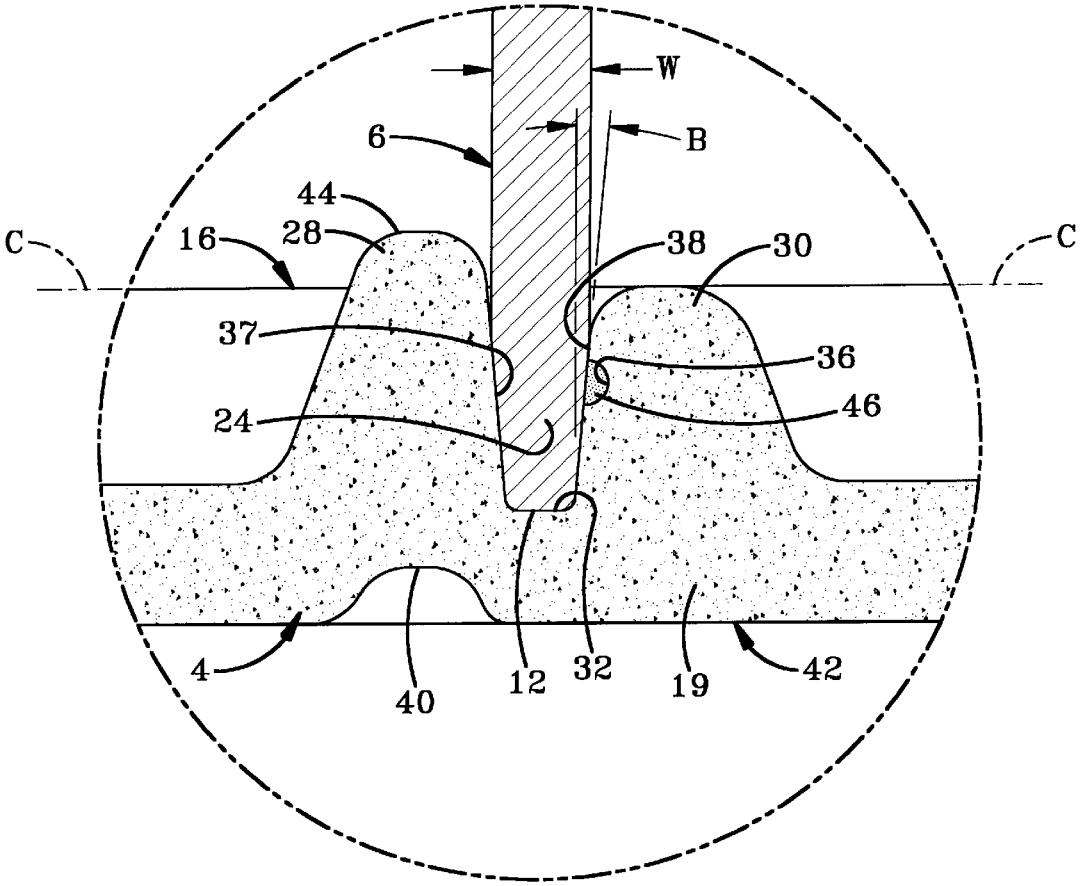
FIG. 4 is a greatly enlarged sectional view of the encircled portion of FIG. 3.

The disposable presswood reel and flanges therefor of the present invention is indicated generally at 1 in FIG. 1 and is shown holding a cable or wire 2. Reel 1 includes a pair of circular end flanges 4 and a cylindrical- or tubular-shaped sleeve 6 extending between and connected to each flange 4. Sleeve 6 has opposed ends 8 and 10 formed with flat end surfaces 12 (FIG. 4). End surfaces 12 extend substantially perpendicular to a central axis A of sleeve 6 which coincides with the axis of rotation of reel 1 (FIG. 1). Sleeve 6 has a constant predetermined wall thickness W (FIG. 4) measured between the inner and outer surfaces of sleeve 6.

End flanges 4 are a one-piece molded presswood member having a diameter greater than the diameter of tubular sleeve 6 forming a space 14 between the outer surface of sleeve 6 and inner surfaces 16 of flanges 4. Cable 2 is coiled around sleeve 6 and held between flanges 4 within space 14. Each end flange 4 includes a substantially flat circular plate member 19 formed with a central opening 20 capable of receiving an axle or shaft, or two opposing shaft extensions, of equipment for coiling or uncoiling cable 2 around sleeve 6. A plurality of recesses 22 are formed in flanges 4 and extend outwardly from adjacent central opening 20 to form a plurality of outwardly extending spoke-like sections 23.

In accordance with one of the main features of the invention, an annular retaining groove 24 is formed in each flange 4 by a pair of outwardly extending circular ribs 28 and 30. Ribs 28 and 30 are formed integrally with inner surface 16 of flanges 4 and extend substantially perpendicular to plate member 19. Ribs 28 and 30 are concentric and are spaced from one another forming groove 24 therebetween. Rib 28 is formed inside of and has a smaller diameter than rib 30. Rib 28 has an outer surface 37 which forms an inner edge of groove 24 and rib 30 has an inner surface 38 which forms an outer edge of groove 24. Ribs 28 and 30 have a rounded outer surface which facilitates the guiding of ends 8 and 10 within retaining groove 24, as described below. Inner rib 28 extends outwardly slightly further than outer rib 30. Groove 24 has a diameter substantially equal to the diameter of sleeve 6 allowing ends 8 and 10 of sleeve 6 to extend within groove 24. Groove 24 is tapered slightly and has a substantially flat bottom 32. The inner and outer edges of groove 24 are tapered inwardly at an angle B (FIG. 4) which is between 3° and 7° measured from an axis which extends perpendicular to plate member 19. In the preferred embodiment, angle B is approximately 5°. Groove 24 has a width measured along bottom 32 between ribs 28 and 30 which is slightly less than wall thickness W of sleeve 6.

Figure 5:
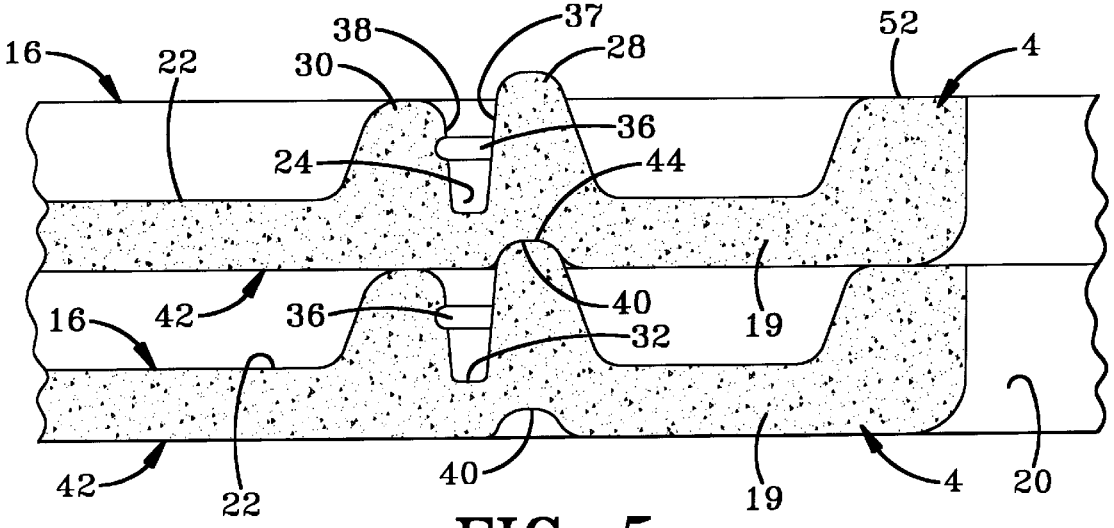
FIG. 5 is an enlarged fragmentary sectional view showing one of the flanges of the disposable reel nestably stacked on another of the flanges.

A small curved adhesive channel 36 is formed in inner surface 38 (FIG. 4) of outer rib 30 for receiving an adhesive 46. Channel 36 is formed generally transversely to inner surface 38 of rib 30 generally parallel to plate member 19 and extends annularly around flange 4. Channel 36 communicates with groove 24 and receives an adhesive, such as a synthetic resin, to retain flanges 4 to ends 8 and 10 of sleeve 6, as described below. Channel 36 is shown in FIGS. 3–5 formed in inner surface 38 of outer rib 30 but could be formed in outer surface 37 of inner rib 28 or could be formed in both surfaces 37 and 38 without affecting the concept of the invention.

In accordance with another of the features of the invention, an annular nesting groove 40 is formed in an outer surface 42 of flanges 4. Nesting groove 40 aligns with inner rib 28 and has a depth substantially equal to the height difference between outer rib 28 and inner rib 30. Nesting groove 40 has a width substantially equal to the width of a rounded upper portion 44 of inner rib 28.

Figure 3:
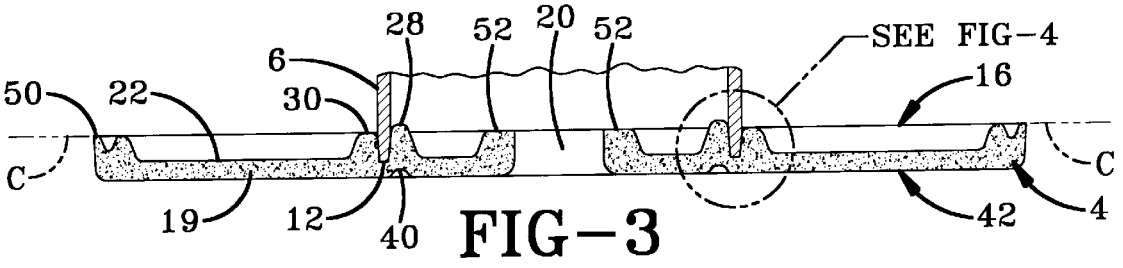
FIG. 3 is a sectional view taken along line 3—3, FIG. 2.

An outer annular lip 50 extends outwardly from a periphery of flanges 4 in the same direction as ribs 28 and 30 (FIG. 3). An inner annular lip 52 extends outwardly around central opening 22 in the same direction as outer lip 50. Lips 50 and 52 strengthen and support flanges 4. Particularly, lip 52 provides support for an axle or shaft which extends within opening 22 when cable 2 is wound on or removed from reel 1. Lips 50 and 52 extend outwardly at approximately the same height to form a plane C. Rib 28 extends outwardly beyond plane C whereby upper portion 44 of inner rib 28 protrudes outwardly further than any other portion of flange 4.

Reel 1 is assembled by aligning ends 8 and 10 of sleeve 6 with groove 24 of flanges 4. A small amount of adhesive is placed within adhesive channel 36 of outer rib 30. The rounded outer surface of ribs 28 and 30 assist in guiding ends 8 and 10 of sleeve 6 into groove 24. Ends 8 and 10 are inserted within grooves 24 until flat end 12 of ends 8 and 10 abut bottom surfaces 32 of groove 24. Because groove 24 has a width slightly less than wall thickness W of sleeve 6, sleeve 6 will be frictionally retained within groove 24 and will be held therein by use of a taper lock press fit or wedging effect which causes ends 8 and 10 to deform into the shape of groove 24 (FIG. 4). In the preferred embodiment, flanges 4 are formed of a rigid presswood while sleeve 6 is formed of a paper or cardboard material. When the softer paper sleeve is forced into groove 24, the rigid presswood of flanges 4 pinches and wedges sleeve 6 to slightly deform the ends of the sleeve, as shown in FIG. 4. This frictional taper lock press fit temporarily holds sleeve 6 to flanges 4 until the synthetic resin or adhesive cures, thereby permanently holding sleeve 6 to flanges 4.

Adhesive channel 36 allows a relatively large amount of adhesive to contact both flanges 4 and sleeve 6 to hold reel 1 in the assembled configuration of FIG. 1. Adhesive channel 36 allows a larger surface area of each of the sleeve and flanges to contact adhesive 46 thus increasing the strength of the bond provided by adhesive 46 and increases the stability of reel 1. Adhesive channel 36 allows a majority of adhesive 46 to remain within groove 24 to hold reel 1 in the assembled configuration and prevents adhesive 46 from being forced or squeezed out of groove 24 when ends 8 and 10 are inserted therein. Most importantly, the ring of adhesive which solidifies within channel 36 will form a solid locking ring in contact with the sleeve, especially when made of paper, preventing the sleeve from pulling apart from the flanges.

Disposable reel 1 eliminates the need for all mechanical metal fasteners such as nuts, bolts and brackets which, in turn, reduces the cost of assembly of reel 1, increases the speed in assembly of sleeve 6 to flanges 4 and eliminates the problem of loosening bolts which occurs over time because of shrinkage of paper sleeve 6 and presswood flanges 4. Flanges 4 are a one-piece molded member which require no additional assembly of other components. Reel 1 is completely recyclable requiring no disassembly or separating of parts before being recycled or discarded after use. The taper lock press fit which holds sleeve 6 to flanges 4 allows reel 1 to be handled immediately after assembly. The frictional wedge fit of ends 8 and 10 of sleeve 6 into groove 24 retains reel 1 in the assembled position even before the adhesive has cured completely.

Nesting groove 40 allows flanges 4 to be stacked upon one another whereby inner ribs 28 extend within nesting groove 40 (FIG. 5) allowing flanges 4 to be stacked upon one another during shipping and storage. Outer rib 30 and lips 50 and 52 abut outer surface 42 of flanges 4 to vertically support flanges 4 on one another in a stacked relationship, while the engagement of inner rib 28 within nesting groove 40 prevents flanges 4 from sliding side to side or tipping over when the flanges are stored in a vertical stack.

Accordingly, tapered groove 24 provides a frictional press fit or wedging effect of ends 8 and 10 of sleeve 6 to flanges 4. Ends 8 and 10 are guided within groove 24 and are sandwiched between ribs 28 and 30 to hold sleeve 6 to flanges 4 while a synthetic resin or adhesive 46 cures within adhesive channel 36 to permanently secure sleeve 6 to flanges 4. Adhesive channel 36 allows a relatively large amount of adhesive 46 to contact both sleeve 6 and flanges 4 to form a strong bond therebetween. Substantially all of the adhesive contained within adhesive channel 36 will remain therein with little to none of the adhesive being squeezed therefrom when ends 8 and 10 of sleeve 6 are inserted within groove 24. Further, nesting groove 40 allows flanges 4 to be vertically stacked upon one another and prevents the stacked flanges from sliding side to side or tipping. Additionally, reel 1 is free of any metal hardware and is completely recyclable.

Accordingly, the improved reel and flanges are simplified, provide an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved reel and flanges are constructed and used, the characteristics of the construction, and the advantageous, new and useful results obtained, the new and useful structures, devices, elements, arrangements, parts and combinations, are set forth in the appended claims.

We claim:

1. A reel for receiving coil, said reel including:

a cylindrical sleeve formed with a central opening and having inner and outer surfaces and first and second end surfaces;

first and second end flanges, each end flange having inner and outer surface and a substantially flat plate member;

an annular groove formed in the inner surface of each end flange for receiving one of the first and second end surfaces of the sleeve, said groove having inner and outer edges;

a channel formed in one of the edges of the groove and communicating with said groove for receiving an adhesive for securing the sleeve to the end flanges; and a pair of annular ribs extending outwardly from and beyond the inner surface of each flange and on either side of the groove whereby the ribs are concentric and spaced from one another forming the groove therebetween.

2. The reel defined in claim 1 in which the channel extends generally parallel to the plate member; and in which the adhesive forms a solid ring to lock the sleeve in the annular groove.

3. The reel defined in claim 1 in which the sleeve has a wall thickness measured between the inner and outer surfaces thereof.

4. The reel defined in claim 3 whereby at least one of the inner and outer surfaces which form the groove are tapered whereby a bottom portion of the groove has a width slightly less than the wall thickness of the sleeve and whereby the taper extends the entire length of the inner and outer surface and the first and second ends of the flange are tapered to complimentary relate to the grooves.

5. The reel defined in claim 4 in which the inner and outer surfaces which form the groove are angled at between 3° and 7° measured from an axis which extends perpendicular to the plate member.

6. The reel defined in claim 5 in which the inner and outer surfaces which form the groove are at approximately a 5° angle measured from the axis which extends perpendicular to the plate member.

7. The reel defined in claim 4 in which the sleeve is formed of a paper material; in which the flanges are formed of a presswood material; and in which the paper sleeve is wedged between the presswood inner and outer surface which form the groove.

8. The reel defined in claim 1 in which each flange includes a substantially flat plate member and in which the ribs extend substantially perpendicular to the plate member.

9. The reel defined in claim 1 further including an annular nesting groove formed in the outer surface of each flange.

10. The reel defined in claim 9 in which a rib extends outwardly from the inner surface of each flange.

11. A reel for receiving a coil, said reel including:

a cylindrical sleeve having inner and outer surfaces and first and second end surfaces;

first and second end flanges, each flange having inner and outer surfaces;

an annular groove formed in the inner surface of each end flange for receiving one of the first and second end surfaces of the sleeve, said groove having inner and outer edges;

an annular rib extending outwardly from one of the inner and outer surfaces of each flange; and an annular nesting groove formed in the other of the inner and outer surfaces of each flange, said annular nesting groove receives the rib of an adjacent flange for retaining the flanges in a stacked relationship.

12. The reel defined in claim 11 further including a channel formed in one of the edges of the groove and communicating with said groove; and in which an adhesive is contained in said channel and forms a solid locking ring in contact with the sleeve to assist in retaining said sleeve in the annular groove.

13. The reel defined in claim 12 in which the sleeve has a wall thickness measured between the inner and outer surfaces thereof; and in which the groove is tapered whereby a bottom portion of the groove has a width slightly less than the wall thickness of the sleeve.

14. The reel defined in claim 11 in which a pair of annular ribs extend outwardly from the inner surface of each flange; and in which the ribs are spaced from one another forming the groove therebetween.

15. A reel for receiving a coil, said reel including:

a cylindrical sleeve formed with a central opening and having inner and outer surfaces and first and second end surfaces;

first and second end flanges, each end flange having inner and outer surfaces;

an annular nesting groove formed in each outer surface of each flange;

a rib extending outwardly from the inner surface of each flange whereby the annular nesting groove substantially aligns with the rib and receives the rib of an adjacent flange for retaining the flanges in a nested stack relationship;

an annular groove formed in the inner surface of each end flange for receiving one of the first and second end surfaces of the sleeve, said groove having inner and outer edges; and a channel formed in one of the edges of the groove and communicating with said groove for receiving an adhesive for securing the sleeve to the end flanges.

16. The reel as defined in claim 15 in which each flange 9 is formed with a central opening; in which an inner lip extends outwardly from an edge of each opening; and in which an outer lip extends outwardly from a periphery of each flange.

17. The reel defined in claim 16 in which the inner and outer lips extend outwardly substantially the same distance to define a plane; and in which the rib extends outwardly beyond said plane.

* * * * *